US008931117B2

(12) United States Patent
Terrell

(10) Patent No.: US 8,931,117 B2
(45) Date of Patent: Jan. 13, 2015

(54) SWEATBAND

(76) Inventor: Marsha Terrell, Southfield, MI (US)

( * ) Notice: Subject to any disclaimer, the term of this patent is extended or adjusted under 35 U.S.C. 154(b) by 239 days.

(21) Appl. No.: 13/400,144

(22) Filed: Feb. 20, 2012

(65) Prior Publication Data

US 2012/0222193 A1 Sep. 6, 2012

Related U.S. Application Data

(60) Provisional application No. 61/464,233, filed on Mar. 1, 2011.

(51) Int. Cl.
*A42C 5/02* (2006.01)
*A41D 20/00* (2006.01)

(52) U.S. Cl.
CPC ..... *A41D 20/00* (2013.01)
USPC ..... 2/181

(58) Field of Classification Search
CPC ..... A41D 23/00; A41D 25/001; A41D 20/00; D04B 1/24
USPC ..... 2/181, 171, DIG. 11, 918, 170; D2/894, D2/865, 871
See application file for complete search history.

(56) References Cited

U.S. PATENT DOCUMENTS 143,788 A 10/1873 Serrell et al.
206,323 A 7/1878 Chance
1,060,190 A * 4/1913 Kellner et al. ..... 66/171
1,072,471 A * 9/1913 Kellner et al. ..... 66/171
1,072,735 A * 9/1913 Kellner et al. ..... 66/171
1,916,507 A * 7/1933 Green et al. ..... 2/91
1,967,054 A * 7/1934 Grean ..... 33/12
2,042,442 A * 5/1936 Buchman ..... 2/91
2,369,442 A * 2/1945 Davis ..... 2/146
3,229,308 A 1/1966 Jensen
4,394,782 A 7/1983 Wasson
4,462,116 A 7/1984 Sanzone et al.
4,481,681 A 11/1984 Hankin
4,723,325 A 2/1988 Perry
4,856,116 A 8/1989 Sullivan
5,175,887 A 1/1993 Kim
5,305,470 A 4/1994 McKay
5,377,360 A 1/1995 Fleitman
D398,736 S * 9/1998 Hamilton ..... D2/600
5,826,277 A 10/1998 McConville
5,927,296 A 7/1999 Maturaporn
5,963,989 A 10/1999 Robertson
5,987,647 A 11/1999 Ouellette
6,189,151 B1 2/2001 Curtis
D503,027 S * 3/2005 Strong ..... D2/894
D688,851 S * 9/2013 Parker ..... D2/894

* cited by examiner

*Primary Examiner* — Khoa Huynh
*Assistant Examiner* — Anna Kinsaul
(74) *Attorney, Agent, or Firm* — Carlson, Gaskey & Olds P.C.

(57) ABSTRACT

The disclosed sweatband includes a piece of fabric including upper and lower edges. Overcast stitches are provided on ends of the upper and lower edges. Further, there are upper and lower folds in the fabric, such that the upper and lower edges of the fabric are folded toward one another by way of the upper and lower folds. A center seam connects the upper and lower edges of the fabric.

16 Claims, 2 Drawing Sheets

SWEATBAND

RELATED APPLICATIONS

This application claims priority to U.S. Provisional Application No. 61/464,233, which was filed 1 Mar. 2011.

BACKGROUND

Sweatbands, such as headbands and wristbands, are typically worn by individuals to absorb, or wick away, sweat. Sweatbands are also commonly worn as fashion accessories, with sweat absorption being an incidental function.

Headbands, for example, absorb sweat that would otherwise roll from a person's forehead to their face, and potentially into their eyes. Alternatively, or in addition, headbands are worn to hold back a person's hair, and to prevent hair from obstructing the person's line of sight. Headbands are often worn under the helmets of cyclists and motorcyclists. One known headband is a tie-back headband that is made of two separate pieces of fabric stitched together.

SUMMARY

The disclosed sweatband includes a piece of fabric including upper and lower edges. Overcast stitches are provided on ends of the upper and lower edges. There are upper and lower folds in the fabric, such that the upper and lower edges of the fabric are folded toward one another by way of the upper and lower folds. A center seam connects the upper and lower edges of the fabric.

Further disclosed is a method of making a sweatband. The method includes the steps of providing a piece of fabric including upper and lower edges, stitching overcast stitches on ends of the upper and lower edges, folding the upper and lower edges toward one another by way of upper and lower folds, and stitching a center seam to connect the upper and lower edges of the fabric.

The disclosed sweatband adequately absorbs sweat without being unduly bulky, among other advantages. These and other features of the present disclosure can be best understood from the following drawings and detailed description.

BRIEF DESCRIPTION OF THE DRAWINGS

The drawings can be briefly described as follows.

DETAILED DESCRIPTION

Figure 1:
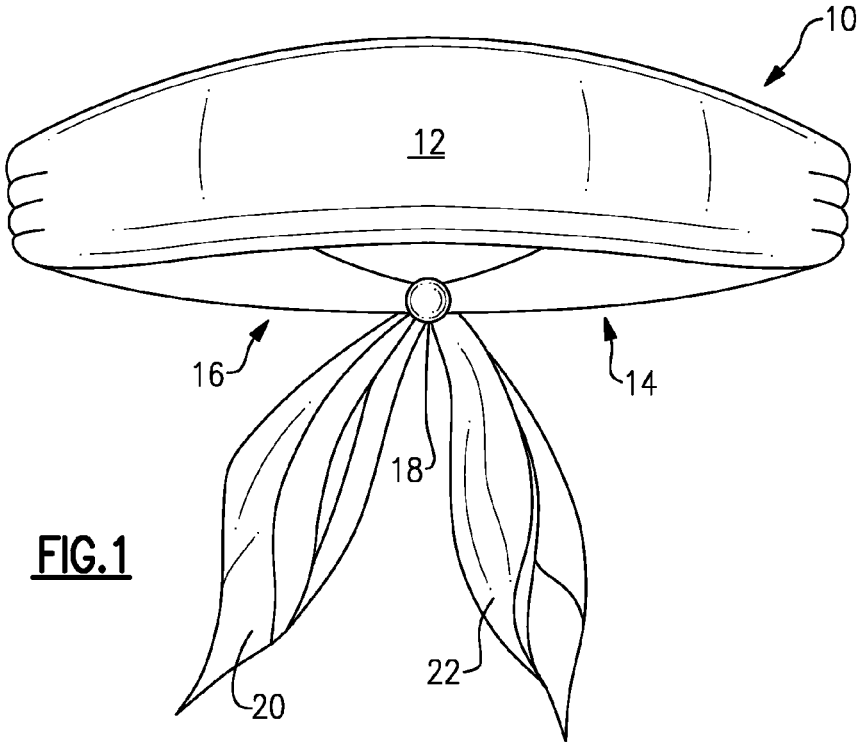
FIG. 1 is a front-perspective view of the disclosed sweatband.

FIG. 1 illustrates an example sweatband 10. The sweatband 10 includes a central portion 12, meant to be arranged adjacent a user's forehead, and end portions 14, 16 at opposed ends of the central portion 12. In this example, the ends 14, 16 of the sweatband 10 are tied-back into a knot 18 such that tails 20, 22 are draped adjacent a user's nape.

In this example, the sweatband 10 is a headband, and is further a tie-back headband. However, this disclosure extends to other types of sweatbands (e.g., wristbands), including sweatbands that are not tie-backs. Further, the sweatband 10 need not be worn in all instances for the purpose of absorbing, or wicking away, sweat, and can instead be worn to hold back hair, or as a fashion accessory.

Figure 2:
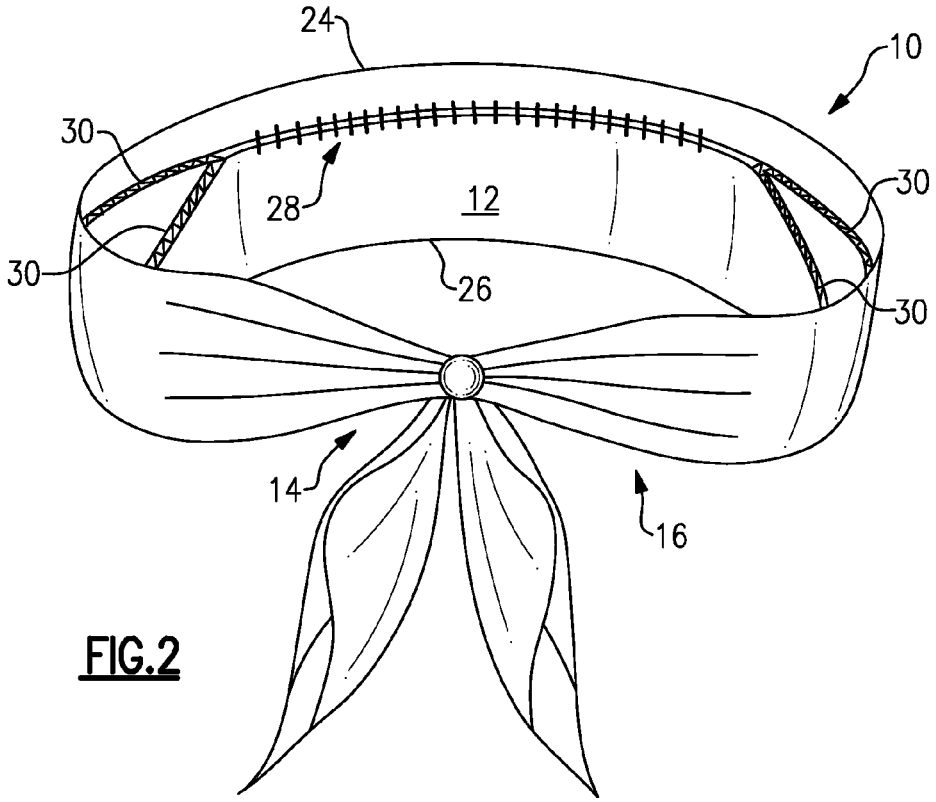
FIG. 2 is a rear-perspective view of the sweatband of FIG. 1.

As illustrated in FIG. 2, the sweatband 10 is provided by a single piece of fabric, as will be explained in detail below. The upper and lower edges of the center section 12 are provided by folds 24, 26 in the fabric. The central section 12 is further provided with a center seam 28 between the edges of the piece of fabric. On either side of the central section 12, the ends 14, 16 of the sweatband 12 include overcast stitches 30 over the edge of the piece of fabric.

Figure 3A:
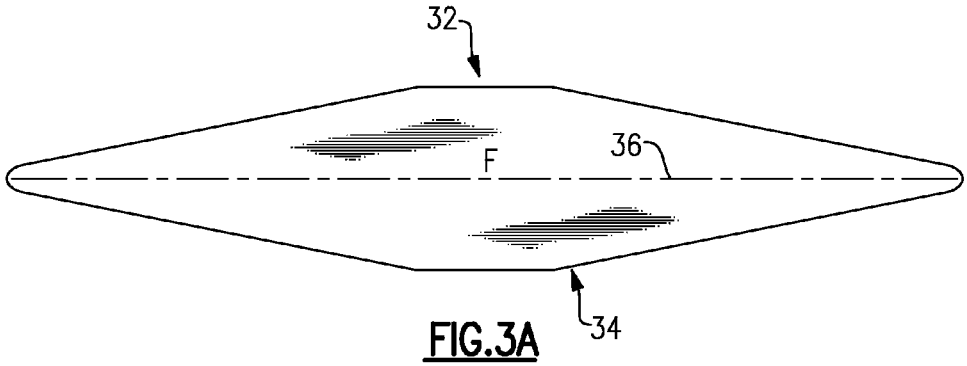
FIGS. 3A-3C illustrate an example method for making the sweatband of FIG. 1.
Figure 3B:
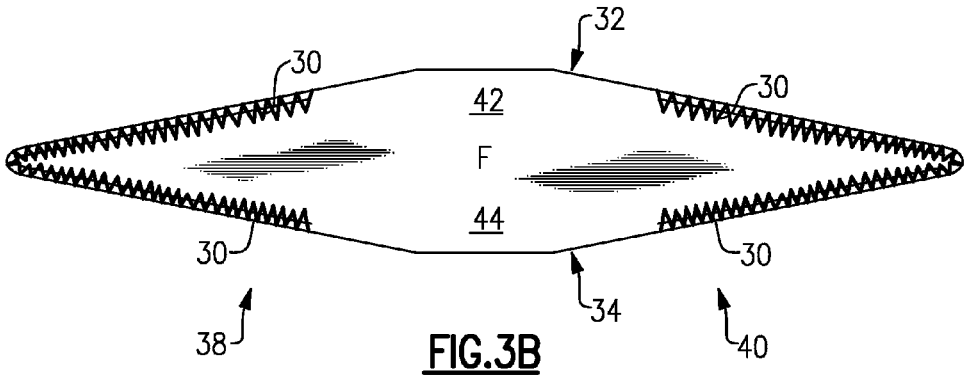
Figure 3C:
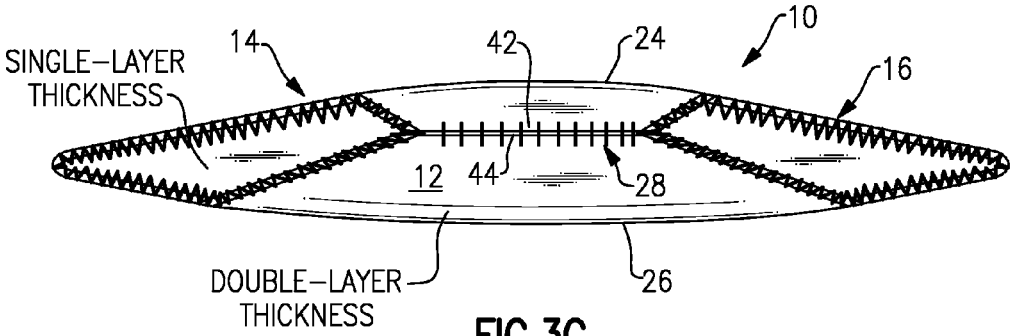

FIGS. 3A-3C generally illustrate the steps associated with making the sweatband illustrated in FIGS. 1-2. In FIG. 3A, a piece of fabric F is cut in a generally diamond shape, and includes an upper edge 32 and a lower edge 34. The piece of fabric F includes a centerline 36 along its length, which defines a longitudinal axis of the piece of fabric F, and is sized, in this example, such that its length is greater than its height. The diamond shape shown in FIG. 3A also defines a height greater in a central portion between the upper and lower edges (32, 34) than a height in other portions between the upper and lower edges.

Notably, the piece of fabric F can be selected from a desired material (e.g., a material configured to absorb sweat, or a material suited to wick away sweat), depending on the intended application for the sweatband, or depending on a customer's desire.

While a diamond shape is shown, the piece of fabric F could be provided in the form of another shape, to provide the sweatband 10 with a look that is different, and perhaps more desirable, for a particular customer. In other words, the piece of fabric F need not be diamond shaped.

Overcast stitches 30 are provided over the upper and lower edges at ends 38, 40 of the fabric F, as illustrated in FIG. 3B. These overcast stitches 30 provide a finished edge to the ends 38, 40 of the piece of fabric F, and prevent the fabric F from fraying. The overcast edges 30 also provide the sweatband 10 with a finished look.

In the illustrated example, certain areas of the upper and lower edges 32, 34 of the fabric F are left without overcast stitches. These areas without overcast stitches are longitudinally between the overcast stitches 30, as indicated at 42 and 44 in FIG. 3B. In the example, the areas 42, 44 are flat portions of the upper and lower edges, such that the upper and lower edges 32, 34 are substantially parallel to the centerline 36 at the areas 42, 44.

The edges 32, 34 could, alternatively, include overcast stitches across their entire length. However, since the center seam 28 will not be seen when the sweatband 10 is worn, the overcast stitches 30 are not needed in this area. These extra stitchings may further cause undesired bulk in the central portion 12.

As illustrated in FIG. 3C, the areas 42, 44 without overcast stitches are folded toward one another by way of the upper fold 24, and the lower fold 26. The center seam 28 is then provided between areas 42 and 44 to define a central portion 12 of the sweatband 10 that has a double layer thickness (e.g., because of the overlap in the fabric F by was of the folds 24, 26). FIG. 3C also defines a height greater in the central portion between the upper and lower folded edges (24, 26) than a height in other portions between the upper and lower edges.

In the illustrated example, the center seam 28 is provided longitudinally between the overcast stitches 30, relative to the longitudinal axis (or, centerline 36) of the piece of fabric F. That is, the stitches forming the center seam 28 are provided without overlapping the overcast stitches 30.

During assembly, the areas 42, 44 can be pinned relative to one another, or relative to some other fixture, when providing the center seam 28. In this example, the upper and lower folds 24, 26 are generally parallel to the centerline 36 of the piece of fabric F. Further, the center seam 28 substantially overlaps the centerline 36, however it is possible to arrange the center seam 28 such that it is offset from the centerline 36.

As mentioned above, this disclosure could relate to a sweatband that is not tied-back, and is instead of a predetermined size. However, the tie-back sweatband may have the added benefit of the tails 20, 22, which can absorb sweat from a user's nape. Further, the tie-back is adjustable, and ensures that the sweatband 10 will have a desired fit around a user's head.

The disclosed sweatband 10 thus effectively absorbs, and/or wicks away sweat (depending on the selected fabric) without being unduly bulky. In particular, the sweatband has a reduced bulk in the central portion 12 thereof (e.g., the portion configured to be adjacent a user's forehead), which provides increased comfort in examples where the sweatband 10 is worn under a helmet.

The disclosed sweatband 10 provides a double-layer thickness, locally, to areas where large amounts of sweat are expected (e.g., a user's forehead), yet requires less overall fabric than sweatbands made from two separate fabric pieces. The disclosed sweatband is otherwise relatively easily made.

Although the different examples have the specific components shown in the illustrations, embodiments of this invention are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A sweatband, comprising:

a substantially diamond shaped piece of fabric including upper and lower edges, each of the upper and lower edges having opposing tapering ends;

wherein the substantially diamond shaped fabric has a height greater in a central portion between the upper and lower edges than a height at a non-central portion between the upper and lower edges of the fabric;

overcast stitches on the opposing tapering ends of the upper and lower edges of the fabric;

an upper and lower fold in the fabric forming upper and lower folded outer edges along at least a portion of the upper and lower edges of the sweatband, wherein the at least a portion of the upper and lower edges are folded toward one another by way of the upper and lower folds, a center seam connecting the upper and lower edges folded toward one another; wherein the center seam is provided between the overcast stitches, and wherein stitches forming the center seam are provided without overlapping the overcast stitches; wherein the stitches forming the center seam are provided in the upper and lower edges of the fabric at flat areas thereof, the upper and lower edges being generally parallel to a centerline of the piece of fabric at the flat areas; and wherein the upper and lower folded outer edges of the sweatband have a height greater in the central portion between the upper and lower folded outer edges than a height at the non-central portion between the upper and lower edges of the fabric.

2. The sweatband as recited in claim 1, wherein the center seam is provided longitudinally between the overcast stitches.

3. The sweatband as recited in claim 1, wherein the sweatband includes a double layer thickness in the central portion.

4. The sweatband as recited in claim 3, wherein the end portions of the sweatband include a one layer thickness.

5. The sweatband as recited in claim 1, wherein the piece of fabric is diamond shaped.

6. The sweatband as recited in claim 1, wherein the sweatband is provided by a single piece of fabric.

7. The sweatband as recited in claim 1, wherein the sweatband is made of a material configured to absorb sweat.

8. The sweatband as recited in claim 1, wherein the sweatband is a tie-back sweatband.

9. The sweatband as recited in claim 8, wherein the sweatband includes end portions, and wherein the end portions are configured to drape adjacent a nape of a user when the sweatband is in a tie-back position.

10. A method of making a sweatband, comprising the following steps:

providing a substantially diamond shaped piece of fabric including upper and lower edges, each of the upper and lower edges having opposing tapering ends; wherein the substantially diamond shaped fabric has a height greater in a central portion between the upper and lower edges than a height at a non-central portion between the upper and lower edges of the fabric;

stitching overcast stitches on the opposing tapering ends of the upper and lower edges of the fabric;

folding at least a portion of the upper and lower edges of the fabric toward one another forming upper and lower folded outer edges along the at least a portion of the upper and lower edges of the sweatband by way of the upper and lower folds, stitching a center seam connecting the upper and lower edges folded toward one another; wherein the center seam is provided between the overcast stitches, and wherein stitches forming the center seam are provided without overlapping the overcast stitches; wherein the stitches forming the center seam are provided in the upper and lower edges of the fabric at flat areas thereof, the upper and lower edges being generally parallel to a centerline of the piece of fabric at the flat areas; and wherein the upper and lower folded outer edges of the sweatband have a height greater in the central portion between the upper and lower folded outer edges than a height at the non-central portion between the upper and lower edges of the fabric.

11. The method as recited in claim 10, wherein the center seam is provided longitudinally between the overcast stitches.

12. The method as recited in claim 10, wherein the piece of fabric is diamond shaped.

13. The sweatband as recited in claim 1, wherein the end portions gradually increase in height approaching the central portion.

14. The method as recited in claim 10, wherein the end portions gradually increase in height approaching the central portion.

15. The sweatband as recited in claim 1, wherein the upper and lower edges of the sweatband, in the central portion, are free of overcast stitches.

16. The sweatband as recited in claim 1, wherein the center seam is offset from the centerline of the fabric.

* * * * *